US008616481B2

(12) United States Patent
Carpenter

(10) Patent No.: US 8,616,481 B2
(45) Date of Patent: Dec. 31, 2013

(54) MATERIAL CONDITIONER WITH REPLACEABLE TEETH

(76) Inventor: Ronald Dean Carpenter, Fries, VA (US)

( * ) Notice: Subject to any disclaimer, the term of this patent is extended or adjusted under 35 U.S.C. 154(b) by 315 days.

(21) Appl. No.: 13/014,838

(22) Filed: Jan. 27, 2011

(65) Prior Publication Data

US 2011/0114773 A1 May 19, 2011

Related U.S. Application Data

(63) Continuation-in-part of application No. 12/263,455, filed on Nov. 1, 2008, now Pat. No. 7,900,859.

(51) Int. Cl.
*B02C 1/08* (2006.01)
*B02C 17/20* (2006.01)

(52) U.S. Cl.
USPC ..... 241/243; 241/294

(58) Field of Classification Search
USPC ..... 241/294, 293, 242, 243
See application file for complete search history.

(56) References Cited

U.S. PATENT DOCUMENTS

| | | | | | |
|---|---|---|---|---|---|
| 2,635,817 | A * | 4/1953 | Long | 241/197 |
| 4,617,709 | A * | 10/1986 | Gundlach | 241/293 |
| 5,064,127 | A * | 11/1991 | Hughes | 241/253 |
| 5,833,153 | A * | 11/1998 | Ackers et al. | 241/192 |
| 2002/0047062 | A1 * | 4/2002 | Keskula et al. | 241/294 |

* cited by examiner

*Primary Examiner* — Faye Francis
(74) *Attorney, Agent, or Firm* — Monty Simmons; Simmons Patents

(57) ABSTRACT

The invention relates to an apparatus and method for conditioning materials for processing wherein such conditioned materials are used in a recycling process. The invention includes a conditioning section comprising a drum associated with a tooth kit. The tooth kit is easily removable from said drum and replaced. The invention also covers the tooth kit.

14 Claims, 14 Drawing Sheets

MATERIAL CONDITIONER WITH REPLACEABLE TEETH

CLAIM TO PRIORITY

This application claims priority to, and is a continuation-in-part to, non-provisional application Ser. No. 12/263,455 filed on Nov. 1, 2008, now U.S. Pat. No. 7,900,859, which is incorporated herein by this reference for all that it discloses.

TECHNICAL FIELD OF THE INVENTION

The present invention relates to an apparatus and method for conditioning materials for processing with replaceable teeth. The invention is particularly useful for conditioning used material to prepare such material for recycling.

BACKGROUND

It is often necessary to condition materials for transport to a facility that uses such material in a commercial process such as power generation, manufacturing, and recycling. Often times such materials contain impurities making it necessary to chop up or pulverize to separate the wanted material from the impurities. In some situations such materials are used plastic containers that need to be conditioned into a more condense form.

One area in particular where a device is often needed to "condition" materials relates to the recycling industry. Recyclable materials include many kinds of glass, paper, metal, plastics, textiles, and electronics. For example, plastic containers are often recycled. Unfortunately, such plastic containers are often more bulky than necessary and may contain unwanted material (such as fluid, dirt, etc.). To assist in making the process of recycling plastic containers more economically feasible, the plastic containers need to be preconditioned to extract the wanted material from the unwanted material. The present invention is a pulverizing/shredding machine well suited for such a purpose.

Prior art pulverizing devices are known such as the machines manufactured by Remcon Equipment, Inc. While such a device works well for its intended purposes, it has its issues. First, Remcon's fingers are curved and spring loaded which allows large pieces of material to pass thereby compromising the effectiveness of the preconditioning process. Second, Remcon's device uses a drum with flat ends that allow material to get trapped between the drum end and the drum housing. Third, such prior art devices need a second row of substantially stationary teeth to better shred the material to be recycled in to smaller pieces than can be easily achieved with only one row of teeth. Forth, such second row of substantially stationary teeth should be easily taken out of the system to allow for bigger pieces of recycled material as required by the recycler.

The invention address all the above described deficiencies in the prior art.

SUMMARY

Objects and advantages of the invention will be set forth in the following description, or may be obvious from the description, or may be learned through practice of the invention.

Broadly speaking, a principal object of the present invention is to provide a material conditioner with configurable replaceable teeth wherein said apparatus is configured to reduce the size of materials and separate impurities from the wanted material where the occurrences of materials becoming lodged inside the machine are minimized or eliminated.

Another general object of the present invention is to provide a tooth replacement kit for a material conditioning apparatus.

Additional objects and advantages of the present invention are set forth in, or will be apparent to those skilled in the art from, the detailed description herein. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
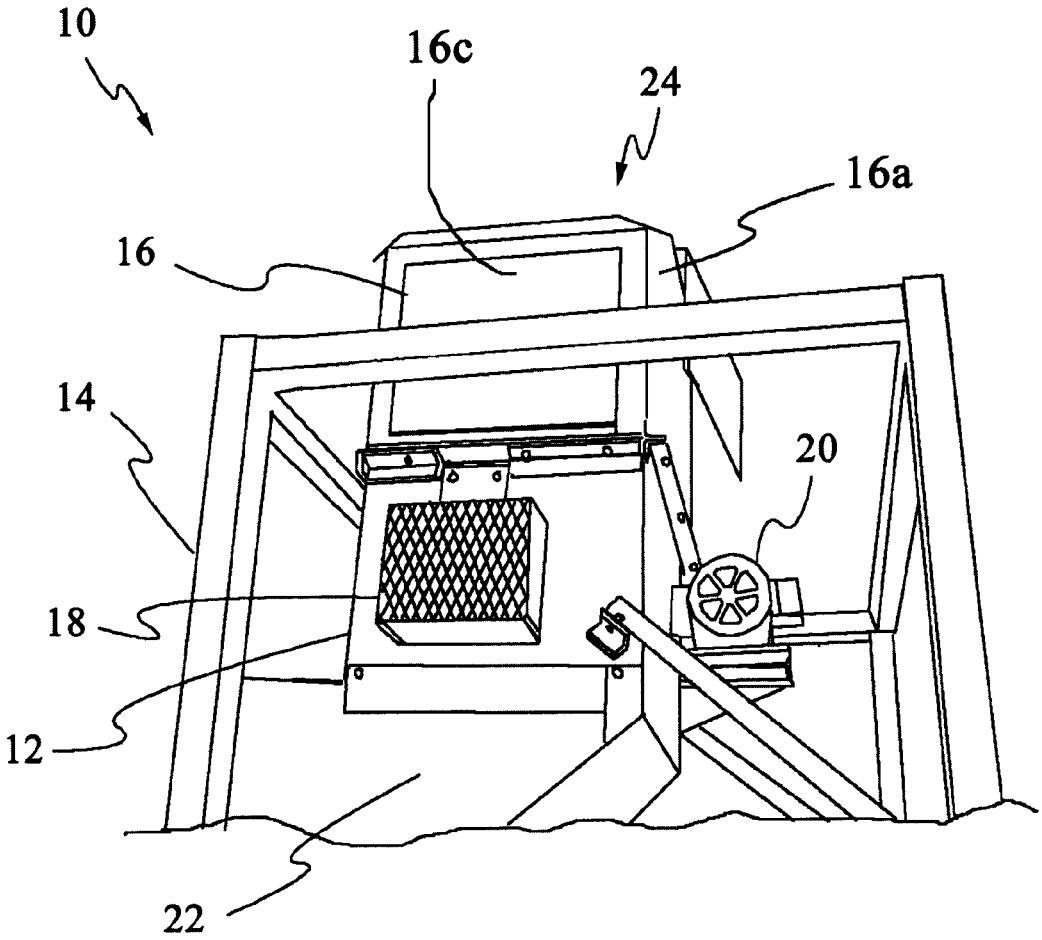
FIG. 1 is an elevated side perspective view of one exemplary embodiment of the invention.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

It should be appreciated that this document contains headings. Such headings are simply place markers used for ease of reference to assist a reader and do not form part of this document or affect its construction.

For the purposes of this document two or more items are "mechanically associated" by bringing them together or into relationship with each other in any number of ways including a direct or indirect physical connection that may be releasable (snaps, rivets, screws, bolts, etc.) and/or movable (rotating, pivoting, oscillating, etc.)

Similarly, for the purposes of this document, two items are "electrically associated" by bringing them together or into relationship with each other in any number of ways. For example, methods of electrically associating two electronic items/components include: (a) a direct, indirect or inductive communication connection, and (b) a direct/indirect or inductive power connection. Additionally, while the drawings illustrate various components of the system connected by a single line, it will be appreciated that such lines represent one or more connections or cables as required for the embodiment of interest.

While the particulars of the present invention may be adapted for use in any process for conditioning materials, the examples discussed herein are primarily in the context conditioning plastic to be used in a recycling process.

Figure 1B:
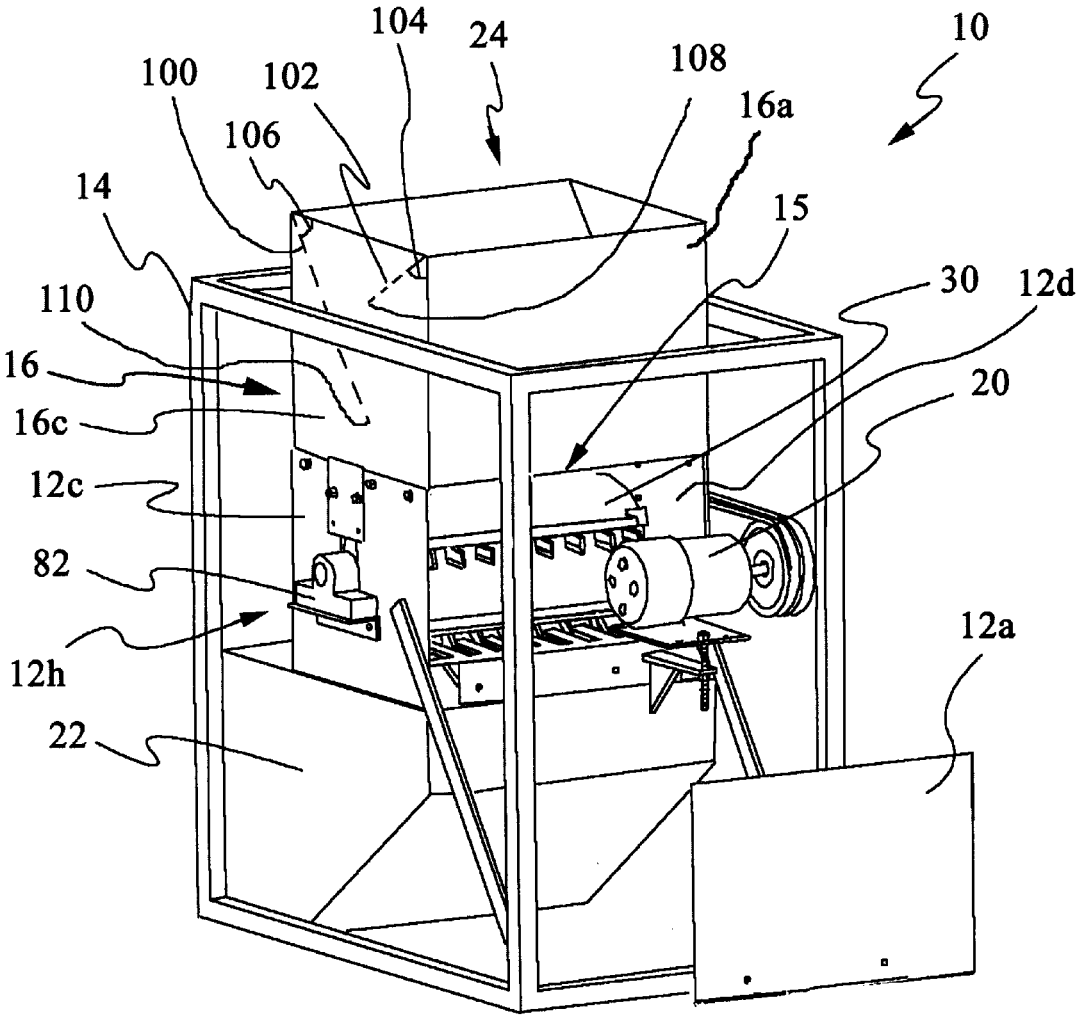
FIG. 1*b* is an elevated side perspective view of one exemplary embodiment of the invention.

Referring now to FIG. 1 and FIG. 1*b*, side perspective views of a material conditioner (10) according to exemplary embodiments of the present invention are considered. Material conditioner (10) comprises a conditioner section (12) disposed between a hopper (16) and an output bin (22). A frame (14) surrounds the various sections and provides structural support. As depicted in FIG. 1*b*, housing wall (12*a*) has been removed to expose a portion of the inside of conditioner section (12) thereby revealing one exemplary embodiment of a mobile-tooth-carrier, drum (30). Similarly, side guard (18, FIG. 1) has been removed to expose one exemplary embodiment of a shaft support, bearing housing (82, FIG. 1*b*).

For the embodiments depicted in FIG. 1 and FIG. 1*b*, conditioner housing (12*h*) comprises two sets of opposing walls; (12*a* opposed by 12*b*) and (12*c* opposed by 12*d*). Such walls are associated with each other so as to define a four wall housing having a housing input positioned at interface (15) (FIG. 1*b*), located at a point of association between hopper (16) and conditioner section (12).

For the presently preferred embodiment of the invention, the hopper (16) comprises two sets of opposing walls; (16*a* opposed by 16*b*) and (16*c* opposed by 16*d*) configured to form a hopper enclosure. The distance between opposing walls (16*a*) and (16*b*) is substantially the same as the distance between opposing walls (12*a*) and (12*b*). The distance between opposing walls (16*c*) and (16*d*) is substantially the same as the distance between opposing walls (12*c*) and (12*d*). One of ordinary skill in the art will appreciate that for such a configuration, the output of hopper (16) will better associate with the input of conditioner housing (12*h*), at interface (15). Thus, material dropped into hopper input (24) will travel through the hopper enclosure, exit the hopper output and fall into the conditioner housing (12*h*) input.

Figure 1C:
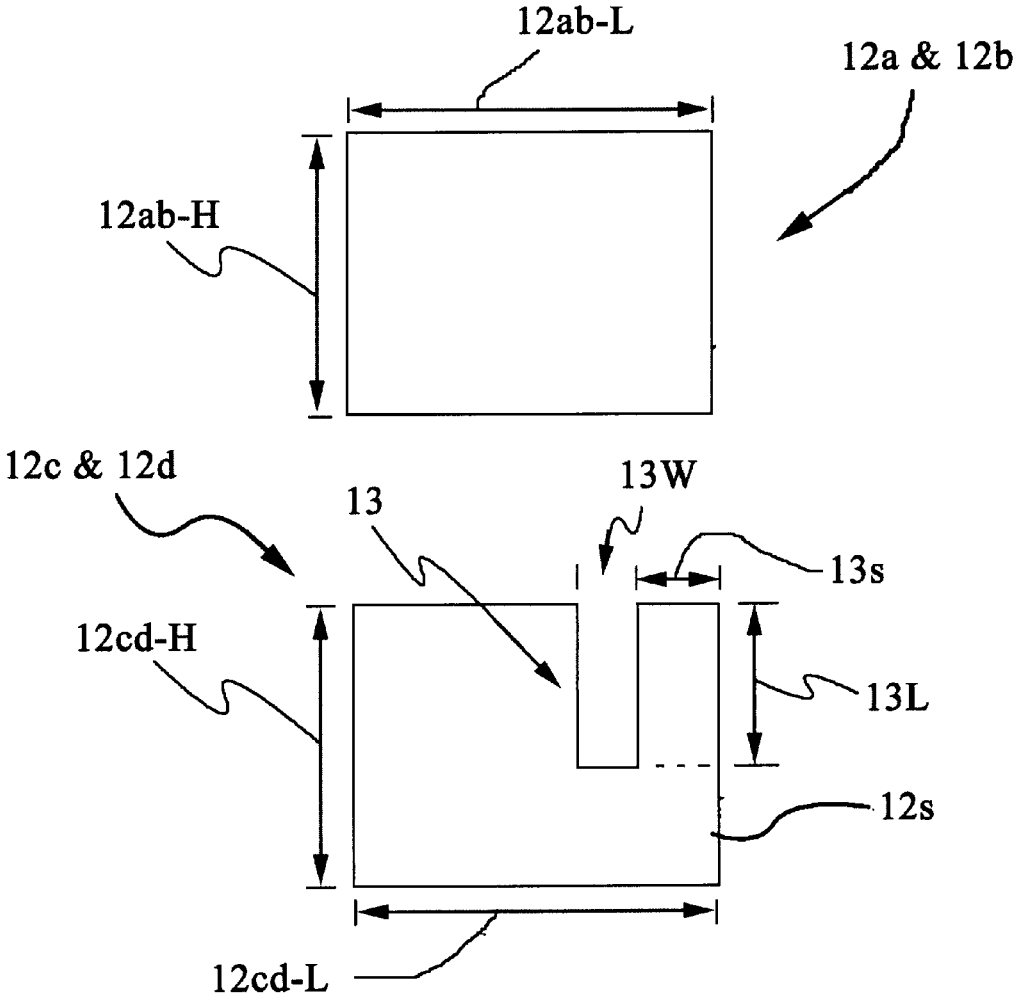
FIG. 1*c* is a side view of conditioner housing walls.

Referring now to FIG. 1*c*, the opposing walls (12*a*, 12*b*, 12*c*, 12*d*) defining conditioner housing (12*h*) are steel plates with a thickness of about one-forth inches. Opposing walls (16*a*) and (16*b*) are rectangular having dimensions (l2*ab*-H× 12*ab*-L) of about twenty and three-forth inches high by thirty and three-forth inches Long (wide, looking at front). The opposing walls (16*c*) and (16*d*) are rectangular having dimensions (12*cd*-H×12*cd*-L) of about twenty and three-forth inches high by twenty-five inches long (deep, looking at front). Opposing walls (16*c*) and (16*d*) further define a cutout (13) having a cutout width (13*w*) of about two and three-forth inches and a cutout length (13L) of about eleven and three-forth inches. Cutout (13) is positioned about nine inches from side (12*s*) as shown in FIG. 1*c*. As will be discussed later in this document, cutout (13) allows the ends of a mobile-tooth carrier to extend through opposing walls (12*c*) and (12*d*) thereby defining a movable association between the two. A six inch by seven inch cover plate is used to cover the unused portion of cutout (13).

Figure 1D:
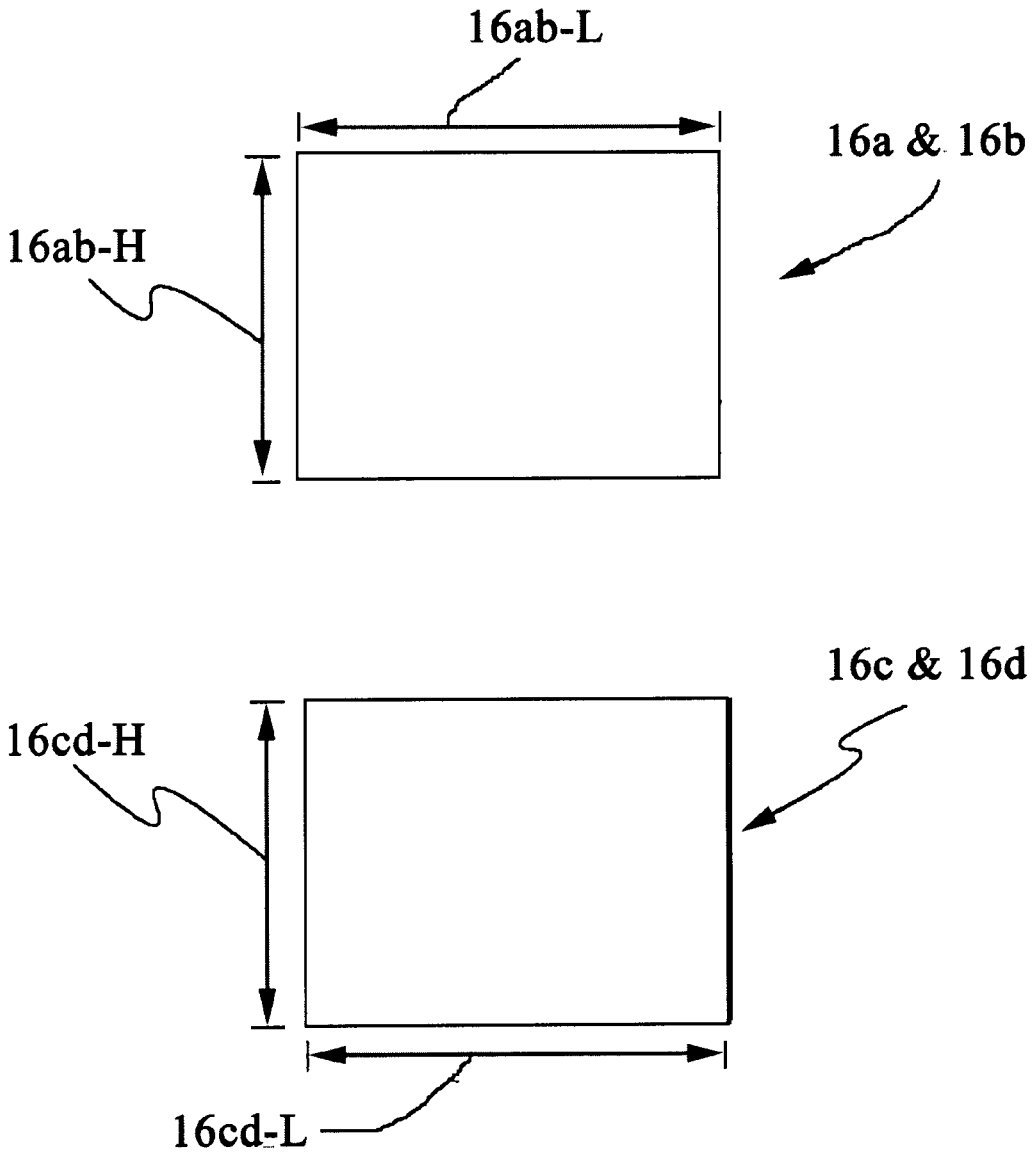
FIG. 1*d* is a side view of hopper housing walls.
Figure 2:
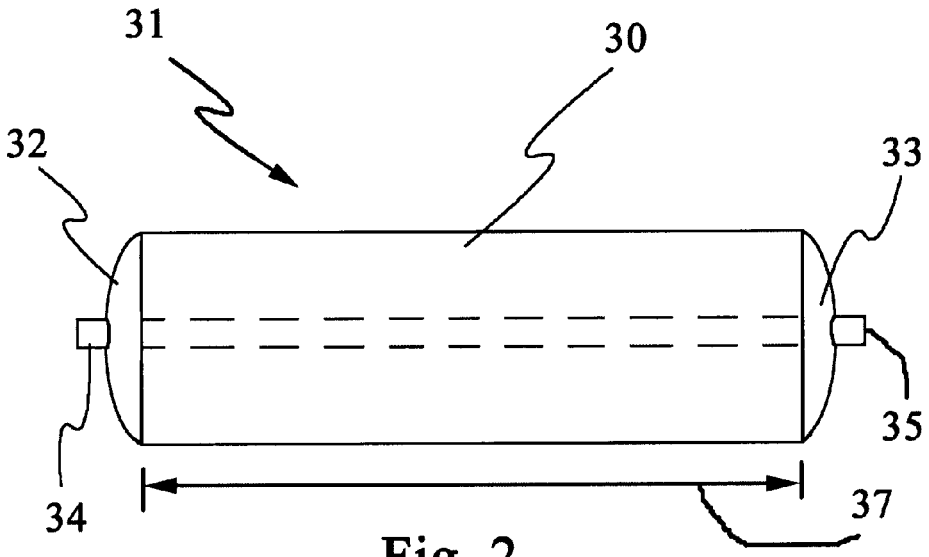
FIG. 2 is a side view of one exemplary embodiment of a mobile-tooth-carrier comprising a drum and a shaft.

Referring now to FIG. 1*d*, for one preferred embodiment, the opposing walls (16*a*, 16*b*, 16*c*, 16*d*) defining the hopper housing are plate steel with a thickness of about one-eight inches. One will notice that the hopper plate steel (⅛ in thick) is thinner than the conditioner housing plate steel (⅜ in thick). Such allows for some production tolerance as the hopper housing rests on top of the conditioner housing. The opposing walls (16*a*) and (16*b*) are rectangular having dimensions (16*ab*-H×16*ab*-L) of about twenty-two inches High by thirty and three-forth inches Long (wide, looking at unit from front). Opposing walls (16*c*) and (16*d*) are rectangular having dimensions (16*cd*-H×16*cd*-L) of about twenty-two inches High by twenty-five and one-forth inches Long (deep, looking at unit from front).

Referring now to FIG. 1*b*, hopper (16) may further include diverter plates. For the presently preferred embodiment, a first diverter plate (102) extends out from about a top edge of hopper wall (16*a*), at a first diverter plate angle (104), to a point about 30% of the way across and about 30% of the way down said hopper wall (16*a*). For this embodiment, the sides of diverter plate (102) adjacent to hopper walls (16*a*, 16*c*, and 16*d*) are secured to such walls by any suitable means such as wielding. A second diverter plate (100) extends from about the top of hopper wall (16*b*), at a second diverter plate angle (106), to a point about 70% across and 80% down said hopper wall (16*b*). Alternatively, the second diverter plate (100) may extend from other points including half-way down said second hopper wall (16*b*), at a second diverter plate angle (106), to a point about 50% across and 50% of the way down said hopper wall (16*b*). It should be appreciated that any suitable diverter plate configurations may be used. Preferably, the second diverter plate (100) endpoint (110) extends beyond the first diverter plate (102) endpoint (108) to prevent substantially all occurrences of items traveling in the reverse direction (i.e. to prevent items from coming out the hopper input).

Figure 3:
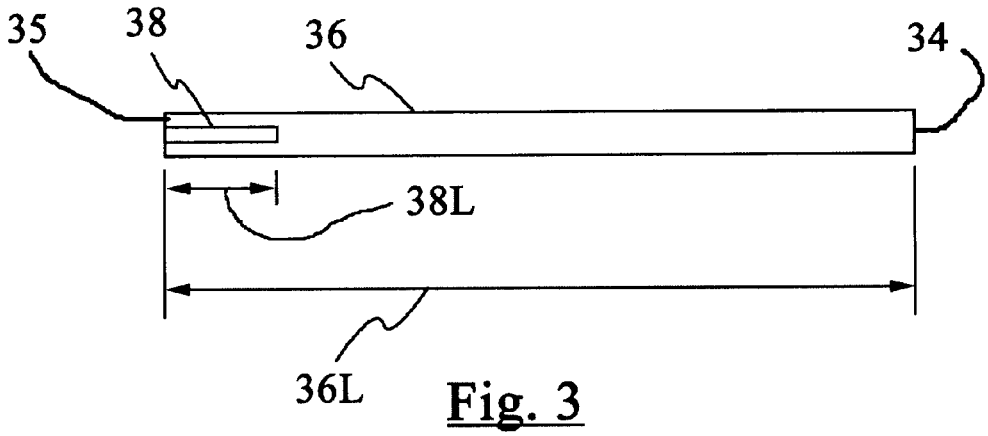
FIG. 3 is a side view of the exemplary shaft depicted in FIG. 2.

Referring now to FIG. 3, one exemplary embodiment of a mobile-tooth-carrier is presented. A mobile-tooth-carrier is simply a device that is configured to be associated with teeth and wherein a second device is associated with the mobile-tooth-carrier, said second device configured to generate mobile-tooth-carrier motion. Consequently, as the mobile-tooth-carrier moves, the teeth associated the mobile-tooth-carrier will also movie; hence the name "mobile-teeth". Any suitable device may be used such as frames, wheels, drums, shafts, etc.

For the presently preferred embodiment, the mobile-tooth-carrier is drum assembly (31) comprising a cylindrical drum (30) having a length (37) of about nineteen and three-forth inches and a diameter of about twelve and three-forth inches. Cylindrical drum (30) is further associated with end caps (32) and (33). Such end caps (32) define a rounded, dome shaped end point for cylindrical drum (30). Referring now to FIG. 3, drum assembly (32) further comprises a drive-shaft (36) with a length (36L) of about forty inches and having a diameter of about two and three-sixteenth inches. One end of draft-shaft (36) defines a key (38) with dimensions of about one-half inch wide, one-fourth inch deep, and seven inches long (38L). Draft-shaft (36) further defines a first-shaft-end (34) and an opposing second-shaft-end (35). When assembled, the first-shaft-end (34) is positioned outside said drum (30) with said drive-shaft (36) extending through the approximate center of said first-drum-end (32), through said drum and out the approximate center of said second-drum-end (33) to said second-shaft-end (35) about seven and one-half inches from the second-drum-end. It should be appreciated that one piece "drum assemblies" fall with the scope of the invention. Such drum-assemblies (31), after being associated with the desired mobile-tooth configuration, are typically balanced to minimize vibrations.

Figure 11:
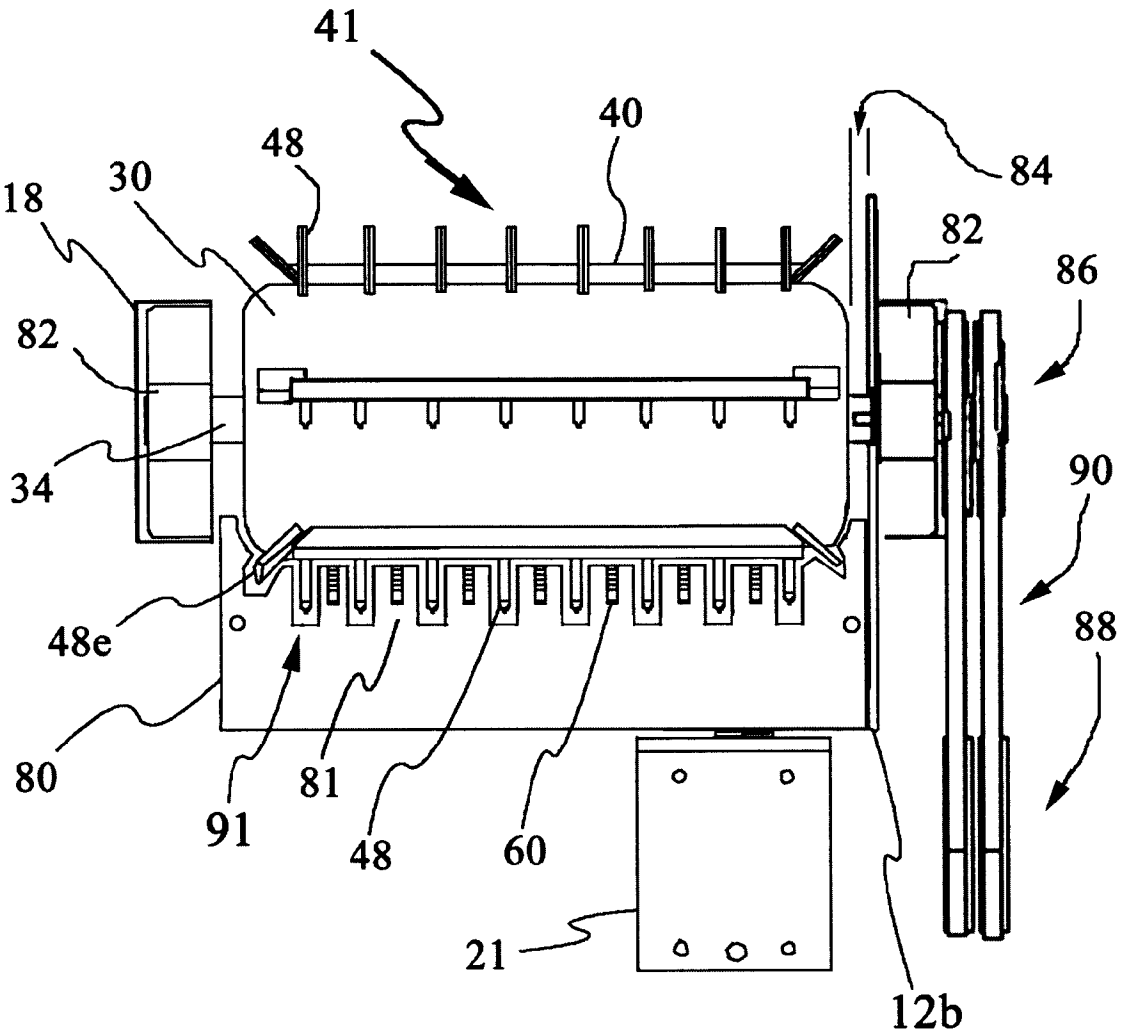
FIG. 11 is a top view of one exemplary embodiment of the invention without housing walls.
Figure 12:
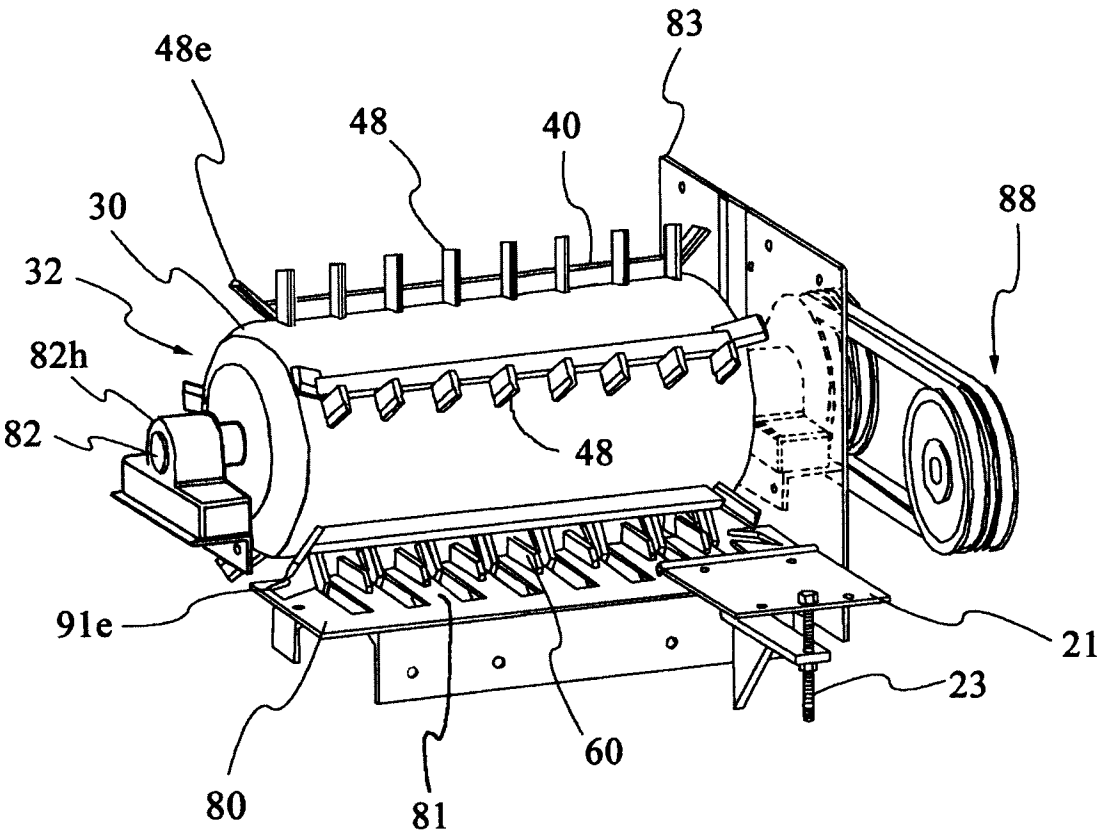
FIG. 12 is an elevated perspective view of the embodiment depicted in FIG. 11.

Referring now to FIG. 11, various embodiments of the mobile-tooth-sets are considered. For one exemplary embodiment of the invention, the mobile-tooth-carrier is configured for being associating with at least two mobile-tooth-sets (41). For the embodiment depicted in FIG. 11, there are five mobile-tooth-sets (three shown in FIG. 11). The mobile-tooth-carrier's first end (34) is movably associated with said first housing wall (12*c*) and said second end is movably associated with said second housing wall (12*d*). For this embodiment of the invention, such movable association is provided by cutout (13) that allows drive-shaft (36) to extend through the walls and rotate relative to the wall as described later.

Mobile-tooth-sets (42) comprise a plurality of mobile-tooths (48) ("tooths" is used instead of "teeth" in an attempt to reduce confusion). For the presently preferred embodiment, cylindrical drum (30) is associated with five mobile-tooth-sets (42) with three sets being shown in FIG. 11. Mobile-tooth-set (41) comprises eight mobile-tooths (48) spaced along the surface of drum (30). For such embodiment, mobile-tooths (48) are in alignment along said cylindrical drum and drive-shaft (36) where the distance between the center points of any two adjacent mobile-tooths are substantially equal. It should be appreciated that some embodiments may have unequally spaced mobile-tooths (48).

Figure 6:
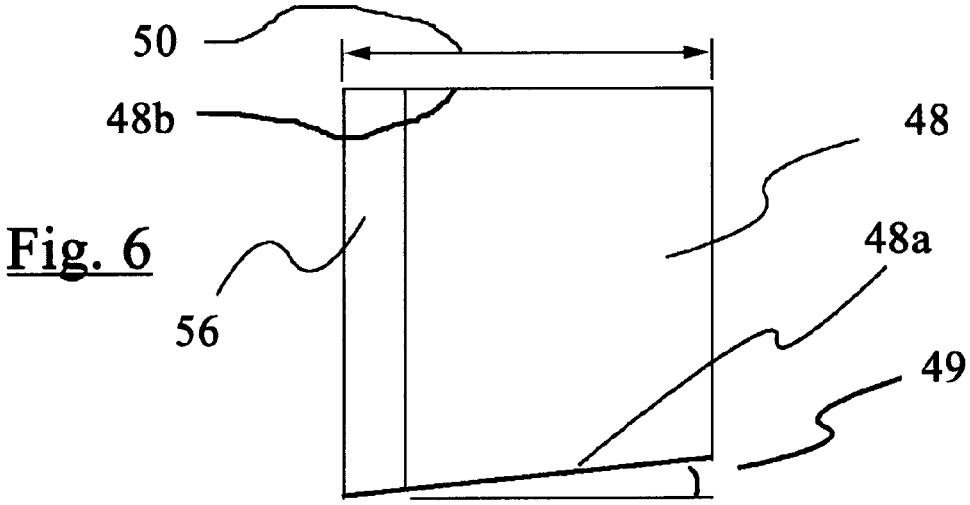
FIG. 6 is a side view of one exemplary embodiment of a mobile-tooth.
Figure 7:
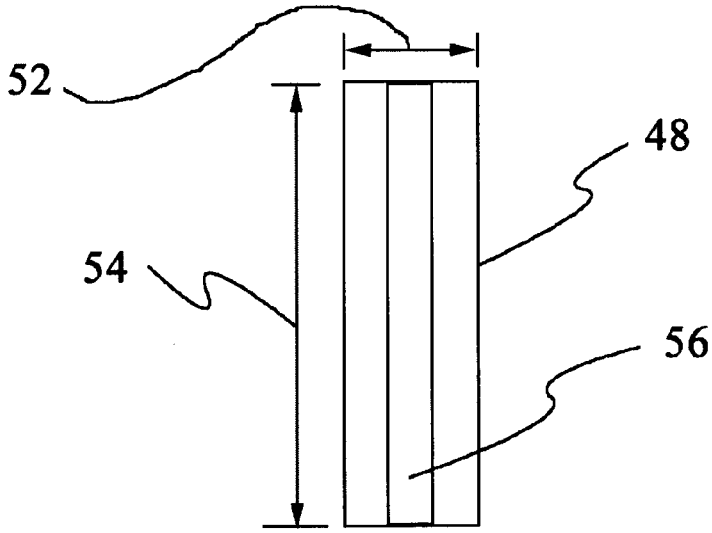
FIG. 7 is a front view of the exemplary mobile-tooth depicted in FIG. 6.

Referring now to FIG. 6, FIG. 7, and FIG. 11, each mobile-tooth (48) comprises a first mobile-tooth end (48*a*) and a second mobile-tooth end (48*b*), wherein the first mobile-tooth end (48*a*) of each mobile-tooth is associated with the surface of drum (30) so that each mobile-tooth (48) extends outward from drum (30) there by defining a tooth. For the presently preferred embodiment, each mobile-tooth (48) is substantially the same size which is about three-eights of an inch thick (52), about three inches long (54), and about one and one-half inches wide (50). Consequently, the first end of each mobile-tooth (48) will be associated with the surface of drum (30) and each mobile tooth extends perpendicularly outward from the drum a distance of about three inches. It should be appreciated that embodiments where mobile-tooth-sets comprise mobile-tooths having a plurality of different sizes that extend out for the mobile-tooth-carrier at the same or different angles fall within the scope of the invention.

As shown in FIG. 6, the first end (48*a*) may be cut at an angle thereby defining a predefined mobile-tooth-angle (49) selected based on the shape of the cylindrical drum at the mobile-tooth to drum interface point. For the presently preferred embodiment, mobile-tooth-angle (49) is about 10 degrees. Such a mobile-tooth-angle improves the mechanical association between the cylindrical drum (30) surface and the first end of the mobile-tooth. The front edge of each mobile-tooth (48) may be further shaped to define a cutting edge. For such a feature, about one-sixteenth of an inch (about 15%) is removed from both sides of the front edge (56) of each tooth.

Figure 4:
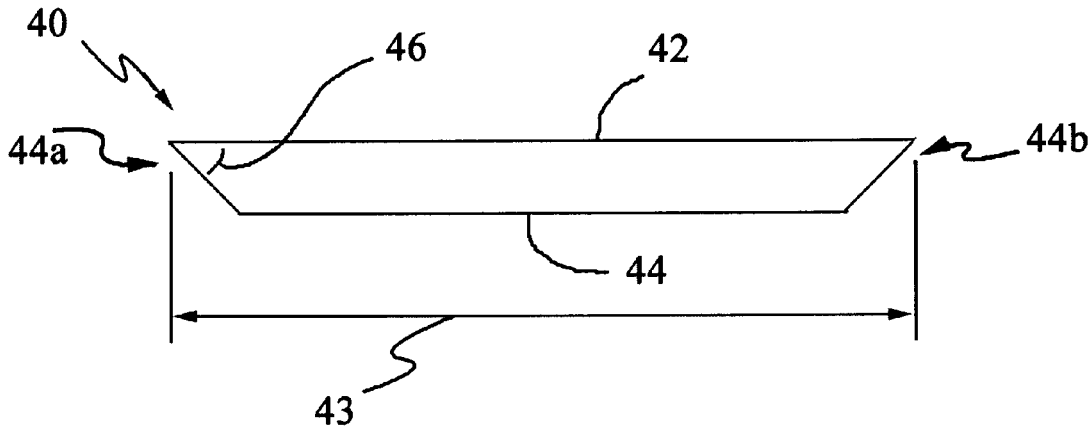
FIG. 4 is a side view of one exemplary embodiment of a mobile-tooth support bar.
Figure 5:
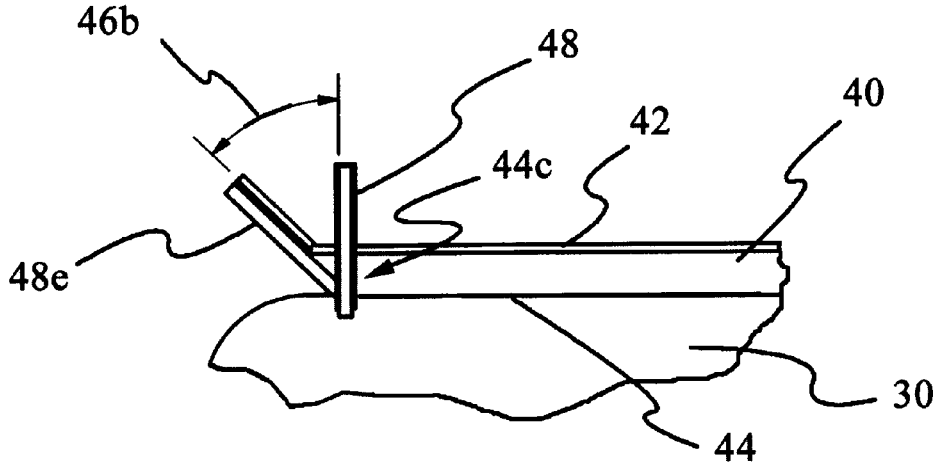
FIG. 5 is a close up view of one exemplary embodiment of an end-tooth associated with one end of a mobile-tooth support bar.

Referring now to FIG. 4, FIG. 5, and FIG. 11, exemplary embodiments of the invention comprising a mobile-tooth support bar (40) are considered. For such embodiments, each mobile-tooth-set comprises a mobile-tooth support bar (40). Support bar (40) defines a first support end (44*a*) and an opposing second support end (44*b*). Support bar (40) is preferably a one inch square bar having a length (43) of about twenty-eight inches.

As shown in FIG. 4, FIG. 5, and FIG. 11, support-bar-surface (44, FIG. 4) of support bar (40) is mechanically associated (welding is one example) with the surface of cylindrical drum (30) so that the first support bar end is positioned a predefined distance from the first cylindrical drum end and so that the second support bar end is positioned a predefined distance from the second cylindrical drum end. In addition, the position of support bar (40) is selected so that a side surface (44*c*) of support bar (40) may be associated with the back side of each mobile-tooth in the mobile tooth set thereby providing support to such mobile-tooths. For example, support bar (40) may be welded to the drum surface and to the back side of each mobile-tooth as shown in FIG. 11. For the present embodiment, there are five support bars (40) positioned around the drum about seven inches apart.

As shown in FIG. 5, for some embodiments, the ends of support bar (40) may be cut to define a support-bar-angle (46*b*). Such allows each end of support (40) to be associated with an end-tooth (48*e*). For the preferred embodiment, support-bar-angle (46*b*) is between about 20 degree and 50 degrees. More specifically, for the current embodiment, support-bar-angle (46*b*) is around 35 degrees.

It will be appreciated by those skilled in the art that by minimizing the distance between the rounded ends of drum (30) [and thereby the support bar (40) end points] and the adjacent conditioner housing walls, the occurrences of materials becoming lodged between the conditioner housing walls and the ends of drum (30) will be minimized. Such a feature is further enhanced by associating an end-tooth with the support bar as described.

Figure 10:
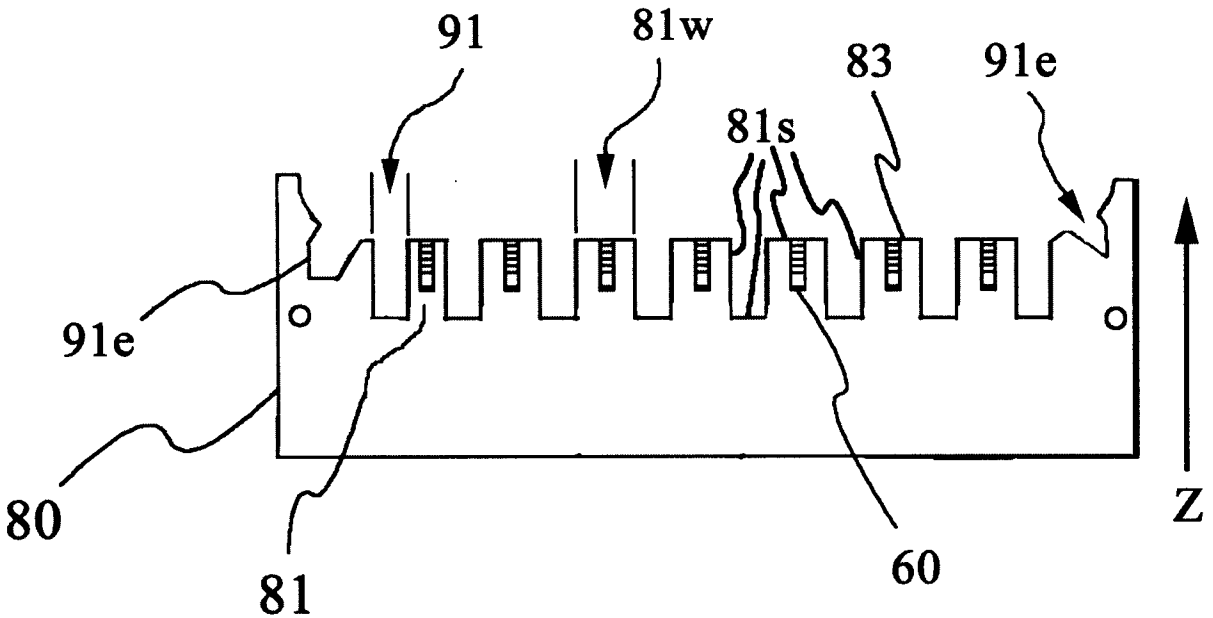
FIG. 10 is a top view of one exemplary embodiment of a finger-plate.

Referring now to FIG. 10, one exemplary embodiment of a finger plate is considered. Finger plate (80) comprises a plurality of fingers (81), wherein each finger (81) extends horizontally out from said finger plate (80), in the Z direction, a predefined distance to a finger-end-point (83) where each finger-end-point (83) defines a finger-interface. One or more sides (81*s*) of fingers (81) may be configured to enhance the material conditioning process. For example, sides (81*s*) may be serrated. Adjacent fingers are separated by a gap thereby defining an adjacent-finger-gap (91). For the presently preferred embodiment, the distance between adjacent adjacent-finger-gaps (91) is about two inches and are substantially equal. Other embodiments included a plurality of adjacent-finger-gaps (91) values.

The distance between each finger-plate-interface (83) and the mobile-tooth-carrier (in this case, drum assembly 31) is selected to define a finger-carrier-gap. The finger-carrier-gap is one parameter that determines the size of the material that exits the material conditioner (10). The finger-carrier-gap is determined by the position selected for the finger-plate (80) relative to the mobile-finger-carrier. For the embodiment depicted in FIG. 11, all fingers are part of an integral finger plate with all fingers defining a substantially equal finger-carrier-gap. Alternative embodiments include fingers (81) of different lengths and different finger-carrier-gaps distances. Another alternative embodiment includes a finger plate design comprising movable fingers associated with a motor to allow remote adjustment of the finger-carrier-gaps. For such configurations, the position of each finger-end-point (83), or groups of finger-end-points may be independently selected.

As depicted in FIG. 1, FIG. 1*b*, and FIG. 11, the mobile-tooth-carrier is associated with a motor configured to generate mobile-tooth-carrier motion, and thereby mobile-tooth motion relative to finger plate (80). For the presently preferred embodiment, an electric motor (20) is associated with one end of drive-shaft (36) via a pulley system (86, 88, and 90). For such embodiment, pulleys (88) associated with motor (20) are seven inches in diameter. Pulley's (86) associated with drive-shaft (36) are nine inches in diameter. Both pulleys (86) and pulleys (88) are v-belt pulleys. One of ordinary skill will appreciated that such a pulley system (86, 88, and 90) allow the power (torque) and speed of drum (30) to be configured by simply changing pulley diameters. For the configuration described above, Motor (20) is a fifteen horse power motor that turns drive-shaft (36) at about 1,750 rotations per minute. Lower horse power motors may be used if the pulley configuration is changed accordingly.

As drive-shaft (36) rotates thereby turning drum assembly (31), mobile-tooths (48) move in a circular path thereby defining a mobile-tooth-motion-path (clockwise for the present embodiment). The relative position of drum-assembly (31) to finger-plate (80), and the configuration of the finger-plate (80) and mobile-tooth-sets (41) are selected so that the mobile-tooth-motion-path for each mobile-tooth goes through an adjacent-finger-gap (91).

Figure 8:
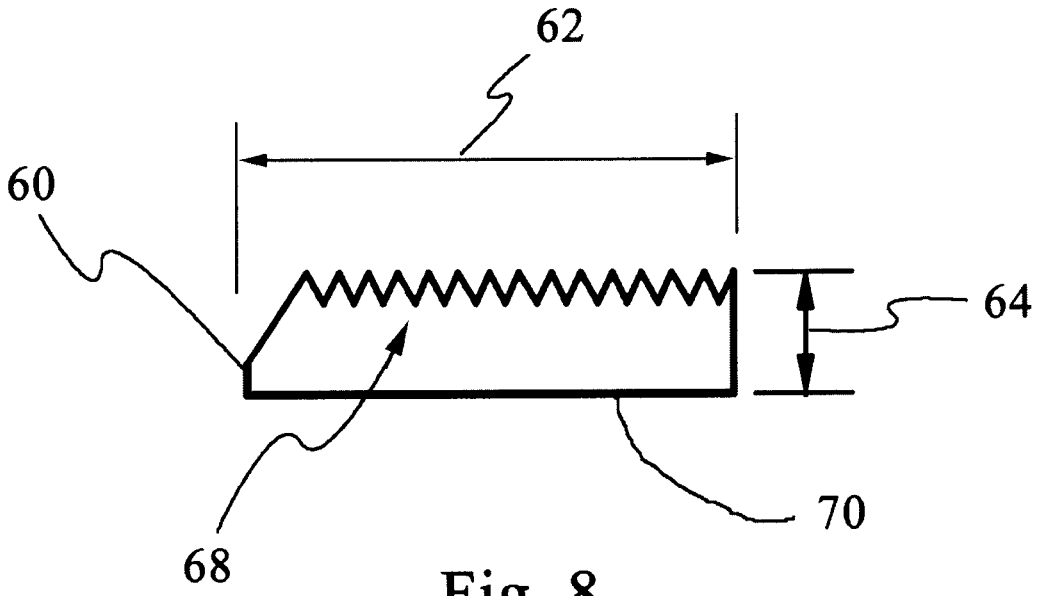
FIG. 8 is a side view of one exemplary embodiment of a finger-tooth.
Figure 9:
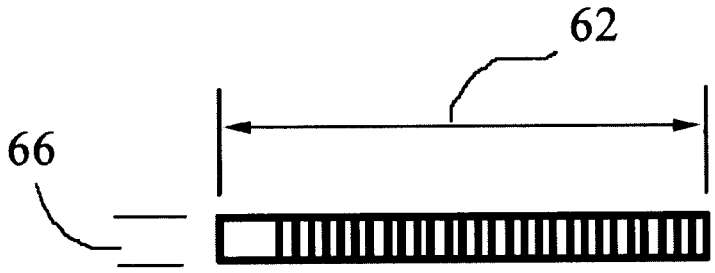
FIG. 9 is a top view of the exemplary finger-tooth depicted in FIG. 8.

Referring now to FIG. 8, FIG. 9, and FIG. 11, exemplary embodiments of finger-tooth (60) are considered. As shown in FIG. 11, a finger-tooth (60) is associated with each finger (81). For the preferred embodiment, finger-tooth (60) has a length (62) of about four inches, a width (66) of about one and one-half inches, and a height (64) of about one-forth inches (although any suitable size may be used). The top surface (68) of finger-tooth (60) may be serrated to enhance the conditioning process. As shown in FIG. 11, the finger-tooth (60) and finger (81) association is a fixed association such as a welded joint. For one alternative embodiment of the invention, fingers (81) are configured with a finger-tooth opening though which finger-tooths protrude. For such a configuration, the finger tooth (60) may be associated with a motor to allow remote lowering and rising of a finger-tooth. A motor may be associated with each finger tooth (60), a motor may be associated with groups of finger-tooths (60), and a single motor may be associated with all finger-tooths (60). Using such a configuration, the material conditioning process can be altered by independently selecting the finger-tooth height.

Figure 13:
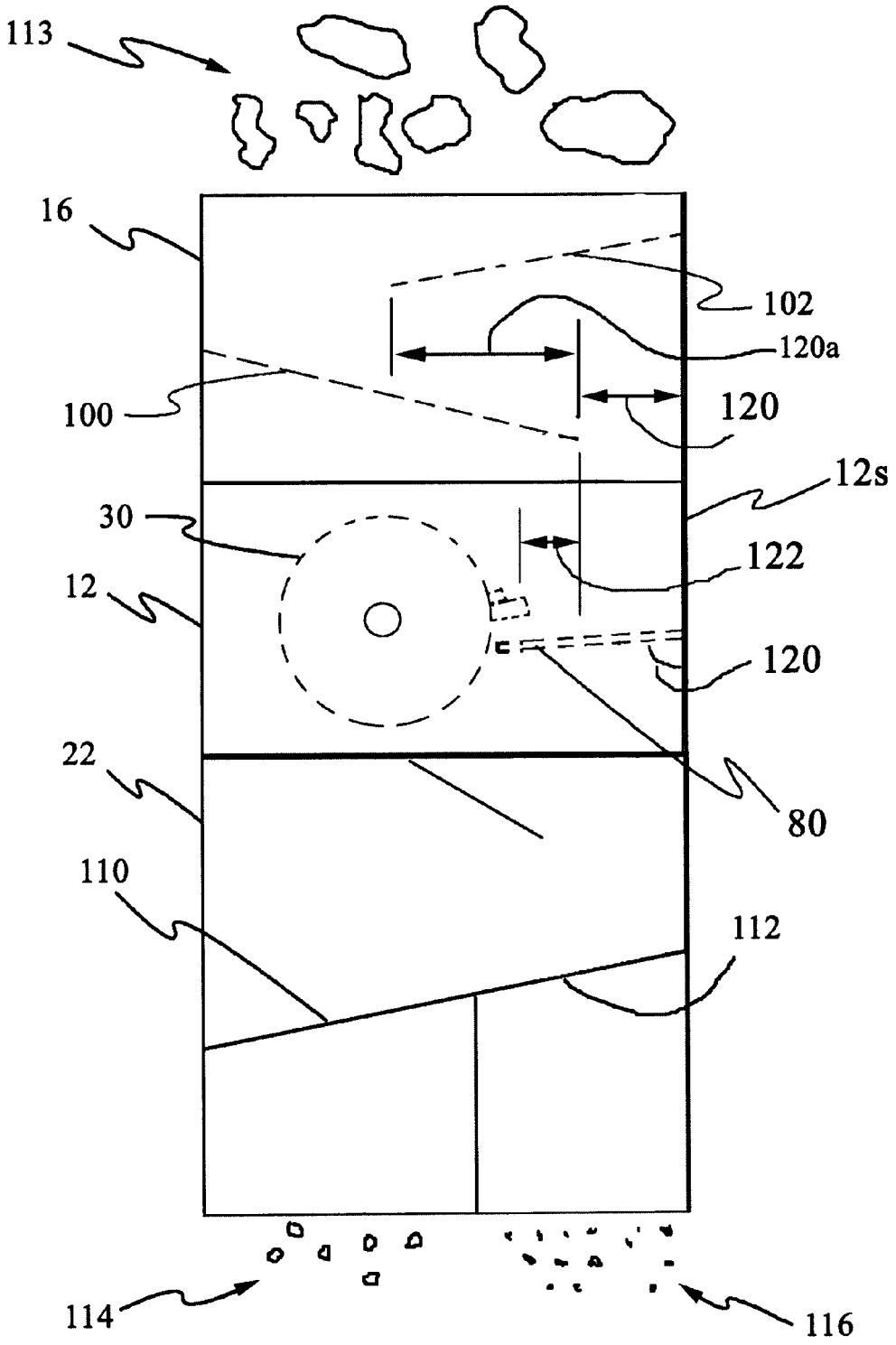
FIG. 13 is a side view of one exemplary embodiment of the invention depicting one possible hopper plate, conditioner section, and output bin configuration.

Referring now to FIG. 13, one exemplary embodiment of the invention is presented with ghost images for components of interest. Hopper (16) presents a slightly different diverter-plate configuration to the one previously described and depicted in FIG. 1. For this embodiment, diverter-plate (100) starts about half-way down and along a hopper wall (16*c*) to a distance (120*a*) beyond the end point of diverter-plate (102) and a distance (122) beyond an endpoint of the drum-assembly (31).

Large pieces of material (113) are dropped into the hopper input, hit diverter-plate (102) and then diverter-plate (100) and then past through the input of conditioner section (12). The rotating drum-assembly (31) crushes, rips, pulverizes, and/or cuts, (etc.) the material (113) into small pieces of material (114) and smaller pieces of material (116), depending on the material conditioner (10) configuration. When material conditioner (10) is configured to only output one size material, output bin (22) is simply a "conduit" of sorts to a transportation apparatus or storage area. When material conditioner (10) configuration includes mobile-teeth of different sizes, adjustable carrier-finger-gap, and adjustable finger-teeth, providing for different sized output pieces, output bin (22) may further be configured to act as a sorter. For this configuration, output bin plate (112) is a grate having openings of a first size so that items too large to fall through such opening will pass to output bin section (110).

Figure 14:
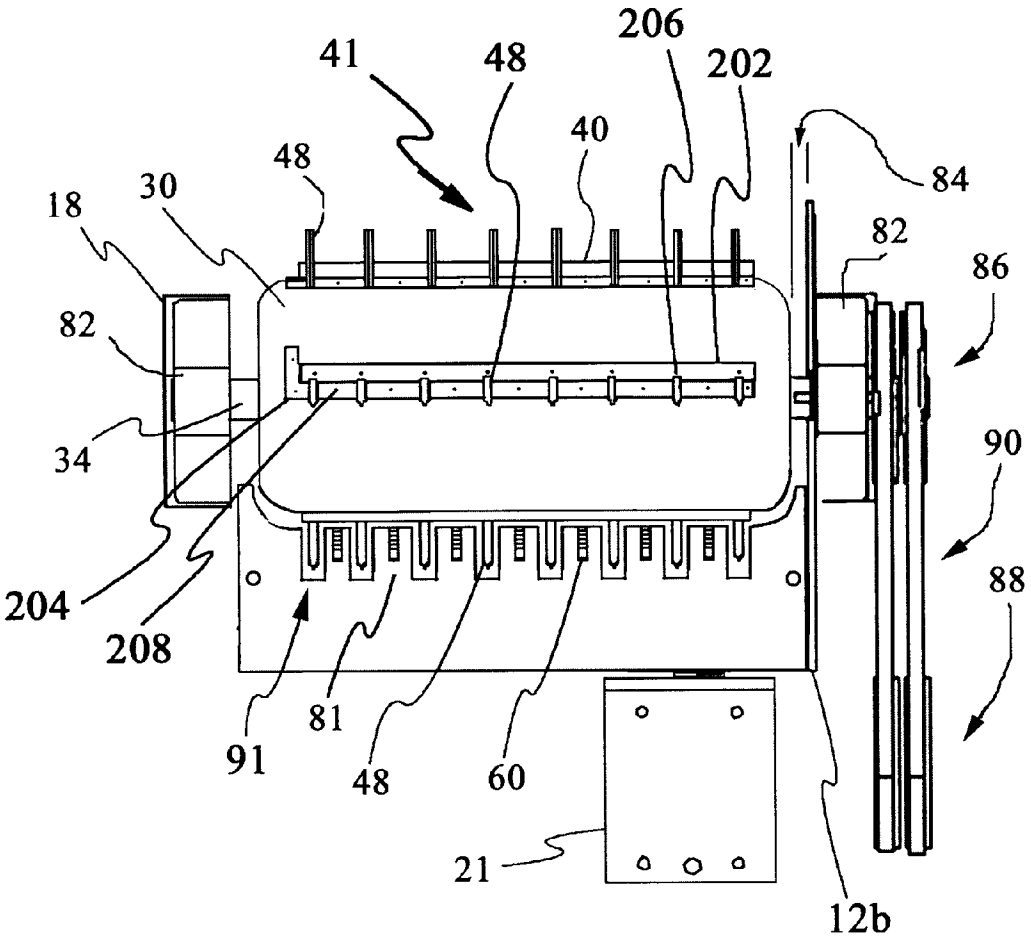
FIG. 14 is a view of the drum assembly of FIG. 11 with a replaceable tooth kit.
Figure 15:
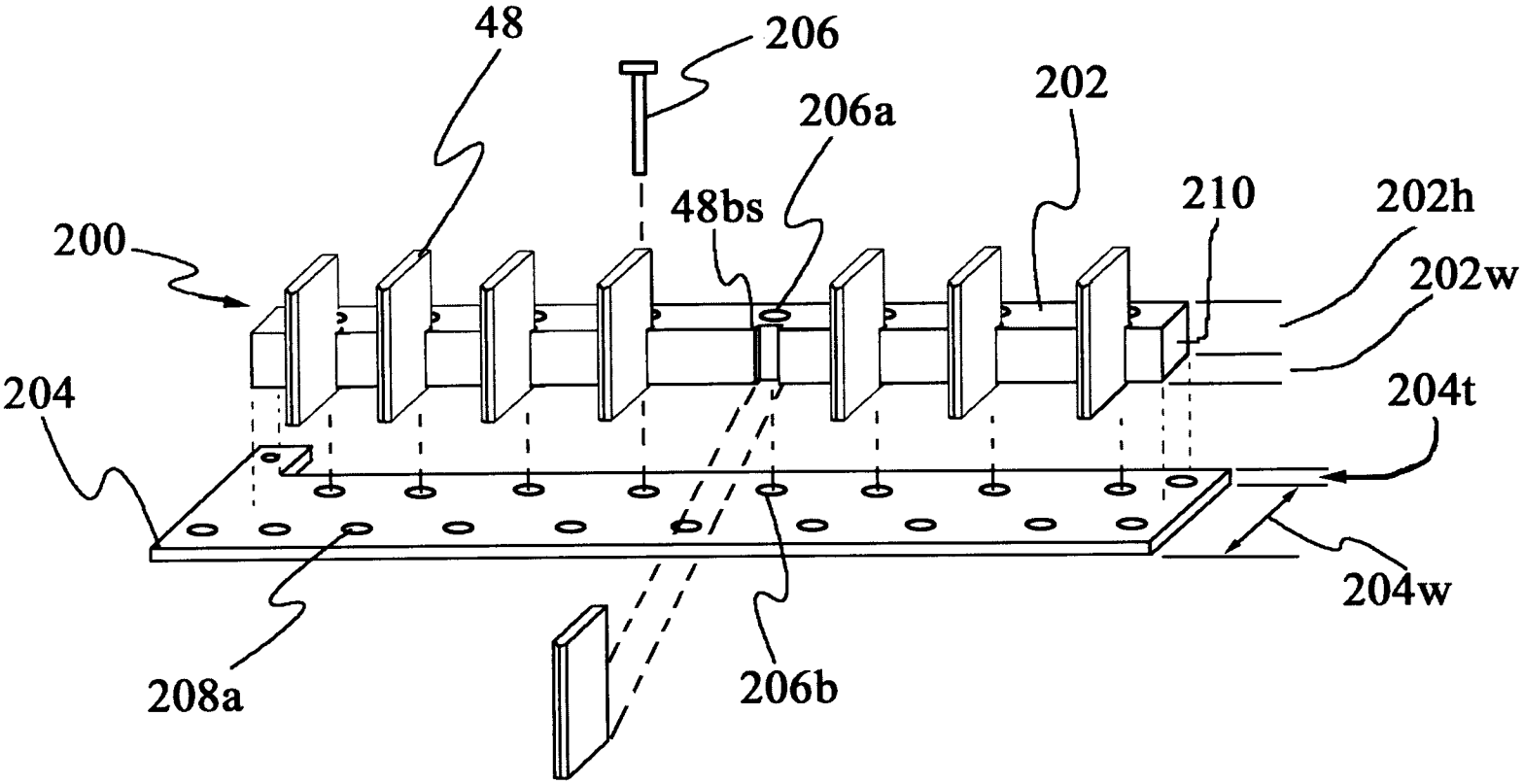
FIG. 15 is a perspective view of a tooth kit.

Referring now to FIG. 14 and FIG. 15, one exemplary alternative embodiment of the invention is presented comprising a mobile-tooth-carrier assembly configured with a replaceable tooth kit. One suitable mobile-tooth-carrier is drum (30). For such embodiment, a replaceable tooth kit (200) comprises support bar (202) mechanically associated with a plurality of bar teeth (48). Alternatively, support bar (202) may define integral teeth (48). Additionally, tooth kit (200) may further comprise support bar interface (204).

For the presently preferred embodiment, support bar (202) defines a plurality of bar-tooth-attachment-points (48*bs*), each configured for being mechanically associated with a bar tooth (48). Similarly, support bar (202) defines a plurality of bar-attachment-points (206*a*) suitably configured to align with a plurality of interface-attachment-points (206*b*). For the present embodiment, each bar tooth (48) is welded to support bar (202) although any method of removably mechanically associating tooth (48) to support bar (202) may be used. It should be noted that the tooth kit (200) comprises eight teeth. One of ordinary skill in the art will appreciate however, that tooth kit (200) may comprise any number of teeth as required for a particular material conditioner configuration.

As depicted in FIG. 14, support bar interface (204) is mechanically associated with the outer surface of drum (30). Support bar interface (204) defines a plurality of drum-attachment-points (208*a*) configured for associating a support bar interface (204) with a drum (30) via attachment mechanism (208). For the currently preferred embodiment, the support bar interface width (204*w*) is about 2.5 inches and the support bar interface thickness (204*t*) is about 0.25 inches. Support bar interface (204) is preferably formed/shaped to match the curved surface of drum (30). Support bar interface (204) further defines a plurality of interface-attachment-points (206*b*) configured for being associated with bar-attachment-points (206*a*) via attachment mechanisms (206) thereby removably associating support bar (202) with support bar interface (204). Support bar interface (204) further defines a plurality of drum-attachment-points (208*a*) configured for securing support bar interface (204) to drum (30).

For this presently preferred embodiment, the drum assembly comprises five support bar interfaces (204) mechanically associated to drum (30) at equal intervals around drum (30). Each support bar interface (204) is preferably milled to the approximate length of drum (30) and is constructed from flat bar steel. Each support bar interface (204) is removably associated with drum (30) with nine attachment mechanisms (208). Suitable attachment mechanisms (208) include ⅜ to ¾ inch fine thread Allen Head Bolts counter sunk into support bar interface (204).

Similarly support bar interface (204) is configured to removably receive support bar (202) via eight support bar attachment mechanisms (206). Suitable attachment mechanisms (206) include ⅜ to 1½ inch fine thread Allen Head Bolts configured to associate with counter sunk hole (206*a*) into support bar (202) and threaded into support bar interface (204).

Support bar (202) is preferably "square stock" having a bar width (202*w*) and a bar height (202*h*) of about 1 inch with a length of about the approximate length of drum (30) and support bar interface (204) as depicted in FIG. 14. It should be appreciated that support bar (202) may not have equal width and high dimensions.

As noted above, support bar (202) is one of (a) mechanically associated with a plurality of teeth (48) or (b) defines a plurality of teeth (48). Preferably, teeth (48) are equally spaced along support bar (202) although unequal teeth (48) spacing may be used are required for the material conditioner configuration of interest. Similarly, tooth kit (200) may be configured with any number of teeth (48) and such would typically be determined by the material conditioner configuration of interest.

Grouser Bar is one suitable embodiment of teeth (48) having dimensions of about 2¾ inches long and 1½ inches wide. As noted above, the back edge of a tooth (48) is preferably suitable for being mechanically associated with a bar-tooth-attachment-point defined by support bar (202). Tooth-slot (48*bs*) is one embodiment of a suitable bar-tooth-attachment-point. Support bar (202) may define a plurality of teeth-slots (48*bs*); one at each tooth attachment point. It should be further noted that the tooth replacement kit (200) depicted in FIG. 15 is not angled at end point (210) and is not associated with an end-tooth (48*e*) as show for the configuration depicted in FIG. 5. That said, embodiments comprising a support bar (202) defining a support-bar-angle (46*b*) (preferably between about 20 and 50 degrees) configured to receive an end-tooth (48*e*) all within the scope of the present embodiment.

While the present subject matter has been described in detail with respect to specific embodiments thereof, it will be appreciated that those skilled in the art, upon attaining an understanding of the foregoing may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A mobile tooth replacement kit configured for being associated with a mobile-tooth-carrier of a material conditioner, said mobile tooth kit comprising:

a support bar defining a plurality of bar-attachment-points and at least one of (a) a plurality of bar-tooth-attachment-points each mechanically associated with a bar tooth, and (b) a plurality of integral bar teeth;

wherein said plurality of said bar-attachment-points are at least one of (a) configured to align with a plurality of interface-attachment-points defined by a support bar interface and further for mechanically associating said support bar to said support bar interface via a plurality of bar attachment mechanisms and wherein said support bar interface defines a plurality of carrier-attachment-points configured for mechanically associating said support bar interface to a surface of said mobile-tooth-carrier via interface attachment mechanisms so that each bar tooth is in alignment with a finger gap defined by a material conditioner finger plate, and (b) configured for mechanically associating said support bar with the surface of said mobile-tooth-carrier so that each bar tooth is in alignment with a finger gap defined by a material conditioner finger plate.

2. A mobile tooth replacement kit as in claim 1, wherein the ends of said support bar define a support-bar-angle configured to receive an end-tooth.

3. A mobile tooth replacement kit as in claim 1, wherein said support bar interface defines a width of about 2.5 inches and a thickness of about 0.25 inches and a length that is about equal to the length of said mobile-tooth-carrier.

4. A mobile tooth replacement kit as in claim 3, wherein said support bar interface defines eight carrier-attachment-points and eight interface-attachment-pints.

5. A mobile tooth kit as in claim 4, wherein said support bar interface further defines eight interface-attachment-points, each configured for being associated with one of said plurality of bar-attachment-points.

6. A mobile tooth replacement kit as in claim 5, wherein the support bar height and a support bar width are about equal and wherein the support bar length is about equal to said support bar interface length.

7. A mobile tooth replacement kit as in claim 5, wherein said support bar defines eight bar-attachment-points.

8. A mobile tooth replacement kit as in claim 5, wherein said teeth are evenly spaced along the length of said support bar.

9. A mobile tooth replacement kit as in claim 5, wherein the ends of said support bar define a support-bar-angle configured to receive an end-tooth.

10. A mobile tooth replacement kit as in claim 9, wherein said support-bar-angle is 30 degrees.

11. A mobile tooth kit replacement as in claim 1, wherein said bar teeth define a grouser bar having dimensions of about 2¾ inches long and 1½ inches wide.

12. A mobile tooth replacement kit as in claim 2, wherein said plurality of bar-tooth-attachment-points define slots.

13. A mobile tooth replacement kit as in claim 12, wherein said interface attachment mechanisms are ⅜ to ¾ inch fine thread Allen Head Bolts and wherein said bar attachment mechanisms are ⅜ to 1½ inch fine thread Allen Head Bolts.

14. A mobile tooth replacement kit configured for being associated with the surface of a drum for a material conditioner, said mobile tooth kit comprising:

a support bar defining a plurality of bar-attachment-points and at least one of (a) a plurality of bar-tooth-attachment-points each mechanically associated with a bar tooth, and (b) a plurality of integral bar teeth; and wherein said plurality of said bar-attachment-points are one of (a) configured to align with a plurality of interface-attachment-points defined by a support bar interface and further for mechanically associating said support bar to said support bar interface via a plurality of bar attachment mechanisms so that each bar tooth is in alignment with a finger gap defined by a material finger plate and (b) configured for mechanically associating said support bar with the surface of said drum so that each bar tooth is in alignment with a finger gap defined by a material conditioner finger plate.

* * * * *